United States Patent [19]

Babiol

[11] 4,261,475

[45] Apr. 14, 1981

[54] BOTTLE STOPPER WITH SEAL

[75] Inventor: Pierre Babiol, Villefranche Sur Saone, France

[73] Assignee: Societe Nouvelle de Bovchons Plastiques S.N.B.P., Paris, France

[21] Appl. No.: 97,623

[22] Filed: Nov. 27, 1979

[30] Foreign Application Priority Data

Dec. 6, 1978 [FR] France ..... 78 34981

[51] Int. Cl.[3] ..... B65D 53/00

[52] U.S. Cl. ..... 215/341; 215/DIG. 1

[58] Field of Search ..... 215/329, 341, 343, 350, 215/351, DIG. 1

[56] References Cited

U.S. PATENT DOCUMENTS

| | | | |
|---|---|---|---|
| 2,989,204 | 6/1961 | Marx | 215/350 X |
| 3,169,656 | 2/1965 | Wieckmann | 215/329 |
| 3,216,600 | 11/1965 | Dreps | 215/329 X |
| 3,331,523 | 7/1967 | Exton | 215/350 |
| 3,433,380 | 3/1969 | Kawchitch | 215/329 |
| 3,979,004 | 9/1976 | Bertario | 215/341 |
| 4,089,463 | 5/1978 | Babiol | 215/329 |
| 4,090,631 | 5/1978 | Grussen | 215/341 X |

FOREIGN PATENT DOCUMENTS 1066175 4/1967 United Kingdom .

*Primary Examiner*—Donald F. Norton
*Attorney, Agent, or Firm*—Dowell & Dowell

[57] ABSTRACT

The present invention relates to a threaded stopper comprising a capsule made of polypropylene and a seal made of EVA. The end of the capsule is offset to lengthen a truncated funnel which is because of its increased length made more supple. The dish-shaped seal element is retained by the funnel and its lip is turned back against the end of the capsule. The invention finds particular application in the packing industry.

4 Claims, 3 Drawing Figures

BOTTLE STOPPER WITH SEAL

The present invention relates to improvements in stoppers for screwed necks and more particularly to a stopper of this type comprising a capsule whose inner part is associated with a seal.

Such a stopper must ensure an excellent tightness and must hold well under pressure on bottles having to be subjected to different heat treatments, such as pasteurisation or even sterilisation in certain extreme cases.

The stoppers in question are provided to be used on returnable bottles of which the dimensions of the bore of the neck have considerable tolerances, in order words, the value of this diameter varies within large proportions. The shape of the edge, i.e. the outer part of the neck, of the bottles in question may also vary considerably.

Presently used stoppers generally do not give satisfaction to consumers, whether they are made in one piece or composed of two elements.

It is an object of the improvements forming the subject matter of the present invention to provide a two-piece stopper composed of a rigid capsule and a moulded seal fixed inside said capsule which presents a supple lip adapted to be turned back against the transverse end of the capsule, this seal being compressed by means of an elastic funnel which the seal covers so that tightness is effected by intimate contact with the interior, the outside and the top of the neck.

The invention will be more readily understood on reading the following description with reference to the accompanying drawings, in which.

Figure 1:
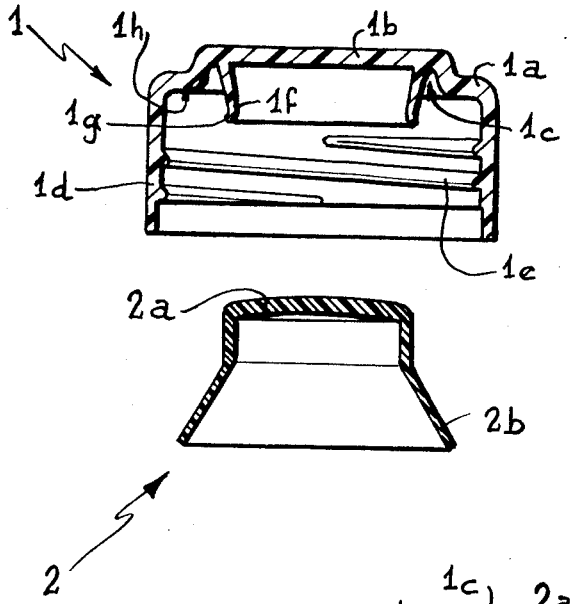
FIG. 1 is an exploded view showing the two elements of a stopper according to the invention.

Referring now to the drawings, FIG. 1 shows a stopper according to the invention comprising a capsule 1 and a seal 2 made respectively of poly-propylene and ethylene-vinyl-acetate (EVA).

The capsule 1 comprises an end 1*a* of which the central part 1*b* is offset outwardly so as to constitute in the capsule a depression 1*c*. In known manner, the inner face of the skirt 1*d* of the capsule is provided with a thread 1*e*. A tubular funnel 1*f* is connected with the central offset part 1*b* of the end, i.e. its origin is in the depression 1*c* and at the level of its junction with the end 1*a*. This funnel is shaped to be conical with downwardly directed opening, its free edge 1*g* being slightly flared out in the direction of the skirt 1*d*. It is therefore observed that the height of the funnel is clearly increased beyond that of a similar element starting from a lower lever at the end 1*a*. Thus, this funnel has a considerable radial suppleness at seal level.

The seal 2 is made in the form of a dish 2*a* of which the free edge of its side wall extends in a truncated lip 2*b* open in the direction opposite that of the dish 2*a*.

Figure 2:
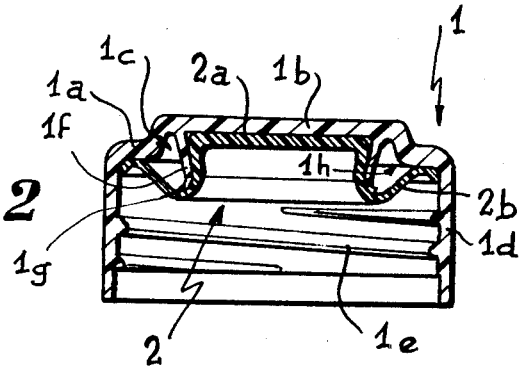
FIG. 2 is a section of the stopper in question before it is placed in position.
Figure 3:
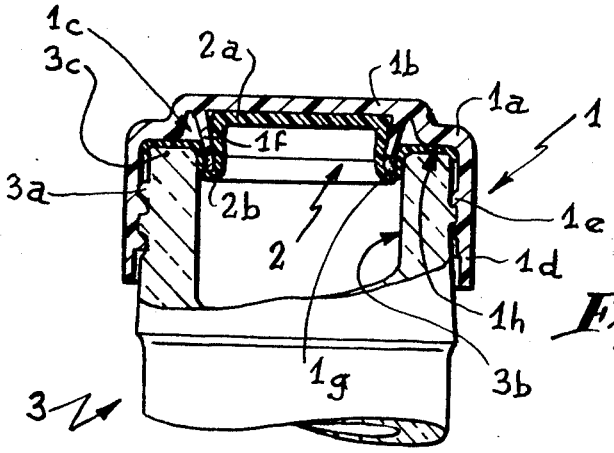
FIG. 3 is a view similar to FIG. 2, but illustrating the stopper once it is screwed on the neck of a bottle.

Due to the suppleness of the material constituting the seal 2, and further to the elasticity of the funnel 1*f*, the dish 2*a* may easily be engaged inside this funnel as shown in FIGS. 2 and 3. The cylindrical wall of said dish then deforms to cooperate with the undercut inner face of the funnel 1*f*.

With the aid of a tubular punch (not shown), the lip 2*b* may easily be turned back so that its edge is applied against the annular face 1*h* of the end of the capsule which surrounds the depression 1*c*. It will be observed that the edge of the lip 2*b* turns back against said face 1*h* and also against the upper part of the inner face of the skirt 1*d*.

When the stopper is placed in position on the neck 3 of a bottle, the capsule 1 is displaced axially as its thread 1*e* cooperates with the thread 3*a* of the neck. This displacement causes the tubular funnel 1*f* to enter the bore 3*b* of the neck 3 so that the corresponding part of the lip 2*b* of the seal 2 is elastically applied against the opening of this bore. In addition, the face 1*h* of the capsule tightens another part of the lip of the seal 2 against the end 3*c* of the neck. Finally, the action of the capsule produces a gripping of the edge of the lip between the interior of the skirt of the capsule 1 and the periphery of the neck 3 (FIG. 3).

Thus, when the necks have bores of very different diameters and variously shaped outer faces, an excellent tightness is obtained as the funnel 1*f* always applies part of the seal elastically against the bores in question and this seal will be crushed against the face 3*c* of the neck 3 and against its periphery. A good tightness is also obtained even if the glass is chipped.

When the stopper is removed from the neck 3, the seal conserves the shape given it when fist screwed so that a stopper is obtained comprising an inner seal of the type such as obtained by casting a plastic material compound on its end.

What is claimed is:

1. A stopper to be secured to the neck of a bottle having a transverse face across the outer end of the neck and having an axial bore extending inwardly of the neck through said face, the stopper comprising:

(a) a capsule having a skirt for surrounding and gripping the neck, and having a closed end with an annular face overlying said transverse face and including a central part overlying the bore and part of said transverse face and offset axially outwardly from the neck and beyond said annular face, and having a tubular funnel extending inwardly from said central part and converging from a larger diameter at said central part to a smaller diameter edge insertable in said bore; and (b) a supple seal comprising a dish portion shaped to fit in said funnel and be retained thereby, and an annular lip portion extending from said dish portion and reversible to turn back about the smaller diameter edge of the funnel to lie against said annular face and extend into contact with and part-way along the inner periphery of the skirt when the stopper is secured to the neck.

2. The stopper as claimed in claim 1, wherein the axial distance from the edge of the funnel to the central part of the capsule is much greater than the axial distance from the edge of the funnel to said annular face of the closed end.

3. The stopper as claimed in claim 1, wherein the dish portion of the seal is coextensive with the funnel and contained therein, and the annular lip portion before it is turned back about the edge of the funnel comprises a truncated cone flaring from said dish portion.

4. The stopper as claimed in claim 1, wherein the outer diameter of the funnel where it joins said central part of the capsule is larger than the diameter of the bore of the bottle neck but smaller than the diameter of said annular face of the closed end and spaced radially inwardly therefrom.

* * * * *